US009613748B2

(12) United States Patent
Kuniyoshi

(10) Patent No.: US 9,613,748 B2
(45) **Date of Patent: *Apr. 4, 2017**

(54) RH DIFFUSION SOURCE, AND METHOD FOR PRODUCING R-T-B-BASED SINTERED MAGNET USING SAME

(75) Inventor: Futoshi Kuniyoshi, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 533 days.

This patent is subject to a terminal disclaimer.

(21) Appl. No.: 14/127,174

(22) PCT Filed: Jun. 25, 2012

(86) PCT No.: PCT/JP2012/066132

§ 371 (c)(1),
(2), (4) Date: Dec. 18, 2013

(87) PCT Pub. No.: WO2013/002170

PCT Pub. Date: Jan. 3, 2013

(65) Prior Publication Data

US 2014/0120248 A1 May 1, 2014

(30) Foreign Application Priority Data

Jun. 27, 2011 (JP) ..... 2011-142077

(51) Int. Cl.
*H01F 41/02* (2006.01)
*H01F 41/00* (2006.01)
(Continued)

(52) U.S. Cl.
CPC ..... *H01F 41/005* (2013.01); *C22C 28/00* (2013.01); *H01F 1/0577* (2013.01);
(Continued)

(58) Field of Classification Search
CPC ..... C22C 2202/02; C22C 28/00; C22C 33/02; H01F 41/005; H01F 41/0293
See application file for complete search history.

(56) References Cited

U.S. PATENT DOCUMENTS 9,293,252 B2 * 3/2016 Kuniyoshi ..... C22C 38/005
9,368,276 B2 * 6/2016 Kuniyoshi ..... H01F 41/0293
(Continued)

OTHER PUBLICATIONS

Official Communication issued in International Patent Application No. PCT/JP2012/066132, mailed on Aug. 28, 2012.

*Primary Examiner* — Roy King
*Assistant Examiner* — Jophy S Koshy
(74) *Attorney, Agent, or Firm* — Keating & Bennett, LLP

(57) ABSTRACT

A method for producing a sintered R-T-B based magnet includes providing a sintered R-T-B based magnet body, where T is mostly Fe; providing an RH diffusion source that includes 0.2 mass % to 18 mass % of a light rare-earth element RL; 40 mass % to 70 mass % of Fe; and a heavy rare-earth element RH as the balance; and performing an RH diffusion process by loading the sintered R-T-B based magnet body, a stirring aid member, and the RH diffusion source into a chamber, and by heating the sintered R-T-B based magnet body, the stirring aid member, and the RH diffusion source to a temperature of 700° C. to 1000° C. while rotating or rocking the chamber. The Fe/RH ratio is within a range from two to seven and is defined by a mass fraction of Fe when a mass fraction of the heavy rare-earth element RH in the RH diffusion sources is three.

2 Claims, 1 Drawing Sheet

(51) Int. Cl.

| | |
|---|---|
| ***C22C 28/00*** | (2006.01) |
| ***H01F 1/057*** | (2006.01) |
| *C22C 33/02* | (2006.01) |

(52) U.S. Cl.
CPC ..... *H01F 41/0293* (2013.01); *C22C 33/02* (2013.01); *C22C 2202/02* (2013.01)

(56) References Cited

U.S. PATENT DOCUMENTS

| | | | |
|---|---|---|---|
| 2008/0286595 | A1 | 11/2008 | Yoshimura et al. |
| 2009/0297699 | A1 | 12/2009 | Baba et al. |
| 2010/0003156 | A1 | 1/2010 | Suzuki et al. |
| 2012/0112863 | A1 | 5/2012 | Kuniyoshi |
| 2013/0087248 | A1 | 4/2013 | Kuniyoshi |

* cited by examiner

RH DIFFUSION SOURCE, AND METHOD FOR PRODUCING R-T-B-BASED SINTERED MAGNET USING SAME

TECHNICAL FIELD

The present invention relates to a method for producing a sintered R-T-B based magnet (where R is a rare-earth element and T is a transition metal element which is mostly comprised of Fe) including an $R_2T_{14}B$ type compound as its main phase.

BACKGROUND ART

A sintered R-T-B based magnet, including an $R_2T_{14}B$ type compound as its main phase, is known as a permanent magnet with the highest performance, and has been used in various types of motors such as a motor for a hybrid car and in numerous types of consumer electronic appliances.

As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if R in the $R_2T_{14}B$ type compound is replaced with a heavy rare-earth element RH, the coercivity of a sintered R-T-B based magnet will increase. It is effective to add a lot of such a heavy rare-earth element RH to the sintered R-T-B based magnet to achieve high coercivity at a high temperature.

However, if the light rare-earth element RL is replaced with the heavy rare-earth element RH as R in a sintered R-T-B based magnet, the coercivity (which will be referred to herein as $H_{cJ}$) certainly increases but the remanence (which will be referred to herein as $B_r$) decreases instead. Furthermore, as the heavy rare-earth element RH is one of rare natural resources, its use should be cut down.

For these reasons, various methods for increasing $H_{cJ}$ of a sintered R-T-B based magnet effectively with the addition of as small an amount of the heavy rare-earth element RH as possible without decreasing $B_r$ have recently been researched and developed.

Patent Document No. 1 discloses a method for producing a sintered R-T-B based magnet which is designed to diffuse a heavy rare-earth element RH such as Dy or Tb inward from the surface of a magnet material and increase $H_{cJ}$ without decreasing $B_r$ by performing the steps of: loading the sintered R-T-B based magnet body and an RH diffusion source which is a metal or alloy of a heavy rare-earth element RH into a processing chamber so that the sintered R-T-B based magnet body and the RH diffusion source are movable relative to each other and brought close to, or in contact with, each other, and heating the sintered R-T-B based magnet body and the RH diffusion source to a temperature of 500° C. to 850° C. for 10 minutes or more while moving the sintered R-T-B based magnet body and the RH diffusion source in the processing chamber either continuously or discontinuously.

On the other hand, Patent Document No. 2 discloses a method for producing a rare-earth magnet with increased $H_{cJ}$ by performing a first step of depositing a heavy rare-earth compound including an iron compound of Dy or Tb on a sintered rare-earth magnet body and a second step of thermally treating the sintered rare-earth magnet body on which the heavy rare-earth compound has been deposited.

CITATION LIST

Patent Literature

Patent Document No. 1: PCT International Application Laid-Open Publication No. WO 2011/7758

Patent Document No. 2: Japanese Laid-Open Patent Publication No. 2009-289994

SUMMARY OF INVENTION

Technical Problem

According to the method of Patent Document No. 1, since the RH diffusion source and the sintered R-T-B based magnet body can be brought close to, or in contact, with each other even at a temperature of 500° C. to 850° C., the heavy rare-earth element RH can be supplied from the RH diffusion source and then diffused inward through the grain boundary.

However, even though the heavy rare-earth element RH can be supplied from the surface of the sintered R-T-B based magnet body, the rate of diffusion inside the sintered R-T-B based magnet body is so low in that temperature range that it will take a lot of time to get the heavy rare-earth element RH diffused sufficiently inside the sintered R-T-B based magnet body.

According to the method of Patent Document No. 1, in a situation where Dy metal, Tb metal, a Dy alloy including more than 70 mass % of Dy, or a Tb alloy including more than 70 mass % of Tb is used as the RH diffusion source, if the diffusion process was carried out at a processing temperature exceeding 850° C., then the sintered R-T-B based magnet body and the RH diffusion source would adhere to each other. Thus, according to that method, the rate of diffusion inside the sintered R-T-B based magnet body cannot be increased even by raising the processing temperature, and an RH diffusion processing temperature exceeding 850° C. cannot be adopted.

Meanwhile, according to the method of Patent Document No. 2, too much Dy-iron compound or Tb-iron compound which is a heavy rare-earth compound is introduced into the main phase of the sintered rare-earth magnet body and $B_r$ decreases, which is a problem.

Thus, to overcome these problems, the present inventors perfected our invention in order to provide an RH diffusion source which can get a heavy rare-earth element RH diffused efficiently inside a sintered R-T-B based magnet body (i.e., a magnet yet to be subjected to an RH diffusion process).

Another object of the present invention is to provide an RH diffusion source which can get a heavy rare-earth element RH diffused inside a sintered R-T-B based magnet body without making the sintered R-T-B based magnet body and the RH diffusion source adhere to each other during an RH diffusion process to be carried out in a wide temperature range of 700° C. to 1000° C. and which can increase $H_{cJ}$ significantly without decreasing $B_r$.

Still another object of the present invention is to provide a method for producing a sintered R-T-B based magnet using such an RH diffusion source.

Solution to Problem

An RH diffusion source according to the present invention is an alloy comprising:

0.2 mass % to 18 mass % of light rare-earth element RL (which is at least one of Nd and Pr);

40 mass % to 70 mass % of Fe; and a heavy rare-earth element RH (which is at least one of Dy and Tb) as the balance.

The heavy rare-earth element RH and Fe have a mass ratio RH:Fe which falls within the range of three to two to three to seven.

A method for producing a sintered R-T-B based magnet according to the present invention includes the steps of:

providing a sintered R-T-B based magnet body (where R is a rare-earth element and T is a transition metal element which is mostly comprised of Fe);

providing an RH diffusion source which is an alloy comprising: 0.2 mass % to 18 mass % of light rare-earth element RL (which is at least one of Nd and Pr); 40 mass % to 70 mass % of Fe; and a heavy rare-earth element RH (which is at least one of Dy and Tb) as the balance, wherein the heavy rare-earth element RH and Fe have a mass ratio RH:Fe which falls within the range of three to two to three to seven; and performing an RH diffusion process by loading the sintered R-T-B based magnet body and the RH diffusion source into a processing chamber so that the sintered R-T-B based magnet body and the RH diffusion source are movable relative to each other and brought close to, or in contact with, each other, and by heating the sintered R-T-B based magnet body and the RH diffusion source to a processing temperature of 700° C. to 1000° C. while moving the sintered R-T-B based magnet body and the RH diffusion source in the processing chamber either continuously or discontinuously.

Advantageous Effects of Invention

An RH diffusion source according to the present invention can get a heavy rare-earth element RH diffused efficiently inside a sintered R-T-B based magnet body.

In addition, an RH diffusion source according to the present invention can also get a heavy rare-earth element RH diffused inside a sintered R-T-B based magnet body without making the sintered R-T-B based magnet body and the RH diffusion source adhere to each other during an RH diffusion process to be carried out in a wide temperature range of 700° C. to 1000° C.

Furthermore, according to a method for producing a sintered R-T-B based magnet according to the present invention, a heavy rare-earth element RH can be diffused efficiently inside a sintered R-T-B based magnet body, and $H_{cJ}$ can be increased significantly without decreasing $B_r$.

DESCRIPTION OF EMBODIMENTS

Figure 1:
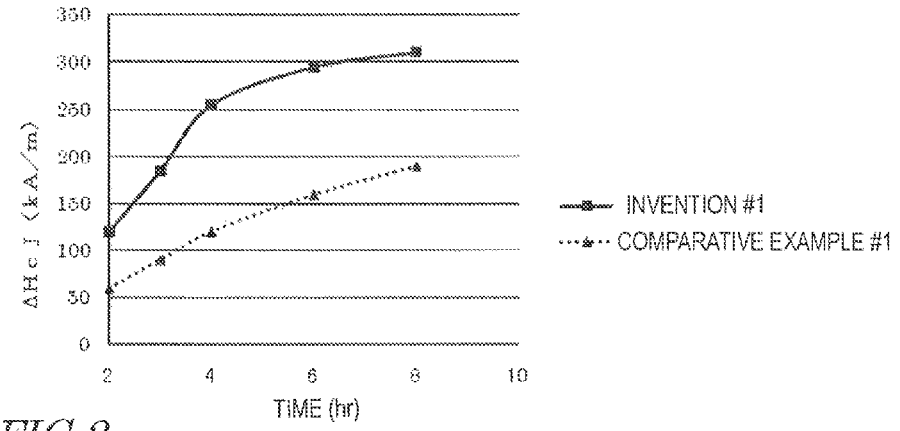
FIG. 1 A graph showing how the $H_{cJ}$ increasing effect changes with the RH diffusion process time in the present invention and in a comparative example.

An RH diffusion source according to the present invention is an alloy comprising:

0.2 mass % to 18 mass % of light rare-earth element RL (which is at least one of Nd and Pr);

40 mass % to 70 mass % of Fe; and a heavy rare-earth element RH (which is at least one of Dy and Tb) as the balance.

The heavy rare-earth element RH and Fe have a mass ratio RH:Fe which falls within the range of three to two to three to seven.

A method for producing a sintered R-T-B based magnet according to the present invention includes the steps of:

providing a sintered R-T-B based magnet body (where R is a rare-earth element and T is a transition metal element which is mostly comprised of Fe);

providing an RH diffusion source which is an alloy comprising: 0.2 mass % to 18 mass % of light rare-earth element RL (which is at least one of Nd and Pr); 40 mass % to 70 mass % of Fe; and a heavy rare-earth element RH (which is at least one of Dy and Tb) as the balance, wherein the heavy rare-earth element RH and Fe have a mass ratio RH:Fe which falls within the range of three to two to three to seven; and performing an RH diffusion process by loading the sintered R-T-B based magnet body and the RH diffusion source into a processing chamber so that the sintered R-T-B based magnet body and the RH diffusion source are movable relative to each other and brought close to, or in contact with, each other, and by heating the sintered R-T-B based magnet body and the RH diffusion source to a processing temperature of 700° C. to 1000° C. while moving the sintered R-T-B based magnet body and the RH diffusion source in the processing chamber either continuously or discontinuously.

In the manufacturing process of the present invention, a liquid phase is produced from the RH diffusion source itself in the RH diffusion process, and the heavy rare-earth element RH can be diffused inside the sintered R-T-B based magnet body through that liquid phase.

Also, in the temperature range of 700° C. to 1000° C. in which the processing temperature needs to fall in the RH diffusion process, the RH diffusion process advances quickly inside the sintered R-T-B based magnet body, and therefore, can be carried out under such a condition that the heavy rare-earth element RH can be diffused easily inside the sintered R-T-B based magnet body.

In this RH diffusion process, by rotating or rocking the processing chamber or by applying vibrations to the processing chamber, for example, the sintered R-T-B based magnet body and the RH diffusion source are moved in the processing chamber either continuously or discontinuously so that the their point of contact changes its position or that they are brought close to, or separated from, each other. In this manner, the heavy rare-earth element RH can be supplied and diffused inside the sintered R-T-B based magnet body in parallel.

(RH Diffusion Source)

The RH diffusion source is an alloy comprising:

0.2 mass % to 18 mass % of light rare-earth element RL (which is at least one of Nd and Pr);

40 mass % to 70 mass % of Fe; and a heavy rare-earth element RH (which is at least one of Dy and Tb) as the balance.

The heavy rare-earth element RH and Fe have a mass ratio RH:Fe which falls within the range of three to two to three to seven.

By using an RH diffusion source with such a composition, $H_{cJ}$ can be increased efficiently through an RH diffusion process to be carried out at a temperature of 700° C. to 1000°

C. In addition, no adhesion will occur, either. This effect is achieved probably for the following reason. Specifically, during the RH diffusion process, a liquid phase which is comprised mostly of a light rare-earth element RL is produced from the RH diffusion source so that the heavy rare-earth element RH can be supplied quickly to the sintered R-T-B based magnet body. Meanwhile, by setting the mass ratio of RH and Fe in the RH diffusion source within the range of three to two to three to seven, $RHFe_2$, $RHFe_3$ and $RH_6Fe_{23}$ compounds will be present in the RH diffusion source and will remain as solid phase even during the processing, thus causing no adhesion there. In addition, since no light rare-earth elements RL form a solid solution with the compound in the RH diffusion source of the present invention, RH diffusion source can maintain its initial ability even when used over and over again.

In this case, if the light rare-earth element RL accounted for less than 0.2 mass % of the RH diffusion source, a liquid phase would be produced from the RH diffusion source during the RH diffusion process too little to introduce the heavy rare-earth element RH from the RH diffusion source into the sintered R-T-B based magnet body efficiently. On the other hand, if the light rare-earth element RL accounted for more than 18 mass % of the RH diffusion source, the sintered R-T-B based magnet body and the RH diffusion source could adhere to each other when the RH diffusion process is carried out at a high temperature of more than 850° C. In addition, if the light rare-earth element RL accounted for more than 18 mass % of the RH diffusion source, the amount of the heavy rare-earth element RH to be supplied from the RH diffusion source would decrease and the effect of increasing $H_{cJ}$ could diminish in some cases.

In this case, if Fe accounted for less than 40 mass % of the RH diffusion source, then the liquid phase would be produced so much during the RH diffusion process that the sintered R-T-B based magnet body and the RH diffusion source could adhere to each other when the RH diffusion process is carried out at a high temperature of more than 850° C. On the other hand, if Fe accounted for more than 70 mass %, then the amount of the heavy rare-earth element RH supplied would decrease, and therefore, $H_{cJ}$ could not be increased so effectively even if the RH diffusion process is performed.

Furthermore, by setting the mass ratio of the heavy rare-earth element RH and Fe within the range of three to two to three to seven, the RH diffusion process can be carried out without causing adhesion in a wide temperature range as described above. If the mass ratio of Fe were less than two, adhesion would be caused. However, if the mass ratio of Fe were more than seven, there would be so little heavy rare-earth element RH in the RH diffusion source that the amount of the heavy rare-earth element RH would decrease and $H_{cJ}$ could not be increased effectively.

At least a part of the RH diffusion source of the present invention is a phase comprised mostly of a light rare-earth element RL (which is at least one of Pr and Nd). For that reason, a liquid phase will be produced from the RH diffusion source during the RH diffusion process to promote introduction of the heavy rare-earth element RH into the sintered R-T-B based magnet body.

The shape and size of the RH diffusion source are not particularly limited. The RH diffusion source may have a spherical shape, a linear shape, a plate shape, a powder shape or any other arbitrary shape. If the RH diffusion source has a spherical or linear shape, its diameter may be set to fall within the range of 1 mm to 20 mm, for example. On the other hand, if the RH diffusion source has a powder shape, its particle size may be set to fall within the range of 0.05 mm to 5 mm, for example.

The RH diffusion source may be made by not only an ordinary alloy production process but also a diffusion reduction process, for example.

According to an alloy production process, a material alloy with a predetermined composition is put into a melting furnace, melted and then cooled to obtain the RH diffusion source.

For example, according to a strip casting process which is an exemplary alloy production process, a melt with a predetermined composition is brought into contact with a water-cooled copper roller which is rotating at a roller surface velocity of 0.1 m/s to 10 m/s, thereby obtaining a melt-quenched alloy. Then, the melt-quenched alloy thus obtained is pulverized by any of various methods including mechanical methods and a hydrogen decrepitation method.

According to an ingot casting process which is another exemplary alloy production process, a melt with a predetermined composition is poured into a water-cooled copper die and cooled, thereby casting an alloy ingot. Then, the alloy ingot thus obtained is pulverized by any of various methods including mechanical methods and a hydrogen decrepitation method.

Optionally, to adjust the size of the RH diffusion source to an easily usable one considering the size of the sintered R-T-B based magnet body to be subjected to the RH diffusion process, the RH diffusion source may have its particle size further adjusted through a sieve.

(Sintered R-T-B Based Magnet Body)

A sintered R-T-B based magnet body provided by the present invention has a known composition, which may include:

- 12 at % to 17 at % of a rare-earth element R;
- 5 at % to 8 at % of B (a portion of which may be replaced with C);
- 0 at % to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and
- T (which is a transition metal consisting mostly of Fe) and inevitable impurities as the balance.

In this case, most of the rare-earth element R is at least one element that is selected from the light rare-earth elements RL (Nd and/or Pr) but that may include a heavy rare-earth element as well. The heavy rare-earth element, if any, suitably includes at least one of Dy and Tb.

A sintered R-T-B based magnet body with such a composition (i.e., a magnet yet to be subjected to the RH diffusion process) may be obtained by a known method for producing a sintered rare-earth magnet.

(Stirring Aid Member)

In an embodiment of the present invention, it is recommended that a stirring aid member, as well as the sintered R-T-B based magnet body and the RH diffusion source, be introduced into the processing chamber. The stirring aid member plays the roles of promoting contact between the RH diffusion source and the sintered R-T-B based magnet body and indirectly supplying the heavy rare-earth element RH that has been once deposited on the stirring aid member itself to the sintered R-T-B based magnet body. Added to that, the stirring aid member also prevents chipping due to a collision between the sintered R-T-B based magnet bodies or between the sintered R-T-B based magnet body and the RH diffusion source in the processing chamber.

It is recommended that the stirring aid member be made of a material that does not react easily with the sintered R-T-B based magnet body or the RH diffusion source even if the member contacts with the sintered R-T-B based magnet body or the RH diffusion source during the RH diffusion process. The stirring aid member is suitably made of zirconia, silicon nitride, silicon carbide, boron nitride or a ceramic that includes any combination of these compounds. Alternatively, the stirring aid member may also be made of an element belonging to the group including Mo, W, Nb, Ta, Hf and Zr or a mixture thereof.

(RH Diffusion Process)

In the RH diffusion process, the sintered R-T-B based magnet body and the RH diffusion source may be moved either continuously or discontinuously in the processing chamber by any known method as long as the relative positions of the RH diffusion source and sintered R-T-B based magnet body can be changed without making the sintered R-T-B based magnet body chip or crack. For example, the processing chamber may be rotated or rocked or vibration may be externally applied to the processing chamber. Alternatively, stirring means may be introduced into the processing chamber with the processing chamber itself fixed.

Hereinafter, a typical example of an RH diffusion process according to the present invention will be described with reference to FIG. 3.

Figure 3:
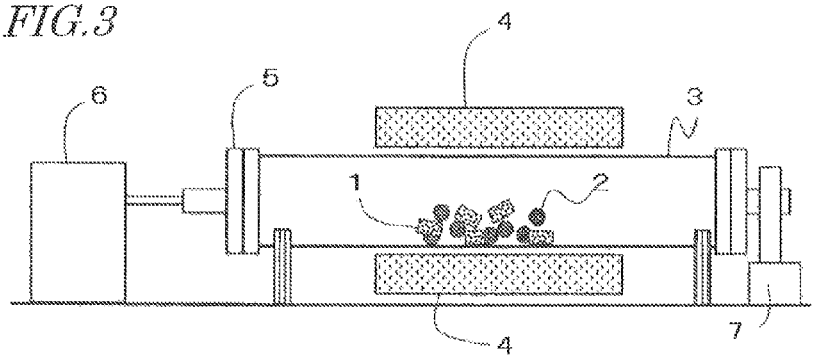
FIG. 3 A cross-sectional view schematically illustrating a configuration for a diffusion system for use in a preferred embodiment of the present invention.

In the example illustrated in FIG. 3, sintered R-T-B based magnet bodies 1 and RH diffusion sources 2 have been loaded into a cylinder 3 of stainless steel. In this example, the cylinder 3 functions as the "processing chamber". The cylinder 3 does not have to be made of stainless steel but may also be made of any other arbitrary material as long as the material has thermal resistance that is high enough to withstand the processing temperature of the RH diffusion process and hardly reacts with the sintered R-T-B based magnet bodies 1 or the RH diffusion sources 2. For example, the cylinder 3 may also be made of Nb, Mo, W or an alloy including at least one of these elements. The cylinder 3 has a cap 5 that can be opened and closed or removed. Optionally, projections may be arranged on the inner wall of the cylinder 3 so that the RH diffusion sources and the sintered R-T-B based magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 3, the cylinder 3 is connected to an exhaust system 6. The exhaust system 6 can lower the pressure inside of the cylinder 3. An inert gas such as Ar may be introduced from a gas cylinder (not shown) into the cylinder 3.

Next, it will be described how to carry out an RH diffusion process using the processing apparatus shown in FIG. 3.

First of all, the cap 5 is removed from the cylinder 3, thereby opening the cylinder 3. And after multiple sintered R-T-B based magnet bodies 1 and RH diffusion sources 2 have been loaded into the cylinder 3, the cap 5 is attached to the cylinder 3 again. Then the inner space of the cylinder 3 is evacuated with an exhaust system 6. When the internal pressure of the cylinder 3 becomes sufficiently low, the exhaust system 6 is disconnected. After that, an inert gas is introduced until the pressure reaches the required level, and the cylinder 3 is heated by the heater 4 while being rotated by the motor 7.

During the RH diffusion process, an inert ambient is suitably maintained in the cylinder 3. In this description, the "inert ambient" refers herein to a vacuum or an inert gas. Also, the "inert gas" may be a rare gas such as argon (Ar) gas but may also be any other gas as long as the gas is not chemically reactive between the sintered R-T-B based magnet bodies 1 and the RH diffusion sources 2. The pressure of the inert gas is suitably equal to, or lower than, the atmospheric pressure. In the cylinder 3, the RH diffusion sources 2 and the sintered R-T-B based magnet bodies 1 are arranged either close to, or in contact with, each other, and therefore, the RH diffusion process can be carried out efficiently even at a high ambient pressure of 1 Pa or more. Also, there is relatively weak correlation between the pressure of the ambient and the amount of the heavy rare-earth element RH supplied, which does not affect the degree of increase in $H_{cJ}$ so much. The amount of the heavy rare-earth element RH supplied to the sintered R-T-B based magnet bodies is more sensitive to the temperature of the sintered R-T-B based magnet bodies than the pressure of the ambient.

During the RH diffusion process, the pressure of the ambient gas (i.e., the ambient pressure in the processing chamber) may be set to fall within the range of 0.1 Pa to the atmospheric pressure.

The cylinder 3 is heated by a heater 4 which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a motor 7 even while being heated by the heater 4. The rotational velocity of the cylinder 3, which is represented by a surface velocity at the inner wall of the cylinder 3, may be set to be 0.01 m per second or more. The rotational velocity of the cylinder 3 is suitably set to be 0.5 m per second or less so as to prevent the sintered R-T-B based magnet bodies in the cylinder from colliding against each other violently and chipping due to the rotation.

While the RH diffusion process is carried out using the RH diffusion treatment system shown in FIG. 3, the surface velocity at the inner wall of the processing chamber may be set to be 0.01 m/s or more, for example. If the rotational velocity were too low, the sintered R-T-B based magnet bodies and the RH diffusion sources would keep contact with each other for so long time as to cause adhesion between them easily. That is why the higher the processing temperature, the higher the rotational velocity of the processing chamber should be. A suitable rotational velocity is determined by not just the processing temperature but also the shapes and sizes of the sintered R-T-B based magnet bodies and RH diffusion sources as well.

By carrying out the heating using the heater 4, the processing temperature of the RH diffusion sources 2 and the sintered R-T-B based magnet bodies 1 is maintained within the range of 700° C. to 1000° C., which is a temperature range suitable for the heavy rare-earth element RH to diffuse quickly inside the sintered R-T-B based magnet bodies. The processing temperature is suitably 800° C. to 1000° C., more suitably 850° C. to 1000° C. If the processing temperature exceeded 1000° C., the RH diffusion sources 2 and the sintered R-T-B based magnet bodies 1 would adhere to each other. On the other hand, if the processing temperature were less than 700° C., then it would take a long time to get the process done. On top of that, if the RH diffusion process were carried out at less than 700° C. for a long time, $B_r$ might decrease as well.

The RH diffusion process may be carried out for 10 minutes to 72 hours, and suitably for 1 to 12 hours. The amount of time for maintaining that temperature is determined by the ratio of the total volume of the sintered R-T-B based magnet bodies 1 loaded to that of the RH diffusion sources 2 loaded during the RH diffusion process, the shape of the sintered R-T-B based magnet bodies 1, the shape of the RH diffusion sources 2, the rate of diffusion of the heavy rare-earth element RH into the sintered R-T-B based magnet bodies 1 through the RH diffusion process and other factors.

(First Heat Treatment Process)

Optionally, after the RH diffusion process, the sintered R-T-B based magnet bodies 1 may be subjected to a first additional heat treatment process in order to diffuse the heavy rare-earth element RH diffused even deeper into the sintered R-T-B based magnet bodies 1. In that case, after the sintered R-T-B based magnet bodies have been separated from the RH diffusion sources, the first additional heat treatment process is carried out within the temperature range of 700° C. to 1000° C. in which the heavy rare-earth element RH can diffuse inside the sintered R-T-B based magnet bodies, more suitably within the range of 850° C. to 950° C. In this first heat treatment process, no heavy rare-earth element RH is further supplied onto the sintered R-T-B based magnet bodies 1 but the heavy rare-earth element RH does diffuse deep inside the sintered R-T-B based magnet bodies 1. As a result, the heavy rare-earth element RH diffusing can reach deep inside under the surface of the sintered R-T-B based magnet bodies, and the magnets as a whole can eventually have increased $H_{cJ}$. The first heat treatment process may be carried out for a period of time of 10 minutes to 72 hours, for example, and suitably for 1 to 12 hours. In this case, the ambient in the processing chamber where the first heat treatment process is carried out is suitably an inert ambient and the pressure of the ambient is not particularly limited but is suitably equal to or lower than the atmospheric pressure. This first heat treatment process may be carried out in either the system that has been used in the RH diffusion process or in a different heat treatment system.

(Second Heat Treatment Process)

Also, if necessary, a second heat treatment process may be further carried out at a temperature of 400° C. to 700° C. However, if the second heat treatment process is conducted, it is recommended that the second heat treatment process be carried out after the first heat treatment process. The second heat treatment process may be performed for a period of time of 10 minutes to 72 hours, and suitably performed for 1 to 12 hours. In this case, the ambient in the processing chamber where the second heat treatment process is carried out is suitably an inert ambient and the pressure of the ambient is not particularly limited but is suitably equal to or lower than the atmospheric pressure. The first and second heat treatment processes may be carried out in either the same heat treatment system or mutually different heat treatment systems.

EXPERIMENTAL EXAMPLE 1

(Efficiency of RH Diffusion Process)

First of all, a sintered R-T-B based magnet body, having a composition consisting of 28.5 mass % of Nd, 1.0 mass % of Pr, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B—H tracer after the heat treatment (at 500° C.×1 hour). As a result, the sintered R-T-B based magnet bodies had an $H_{cJ}$ of 960 kA/m and a $B_r$ of 1.41 T. These values were used as reference values for evaluating the properties of the respective experimental examples to be described below.

The RH diffusion sources were made by weighing Nd, Dy, and Fe so that these elements had the predetermined composition shown in the following Table 1, melting them in an induction melting furnace, bringing the melt into contact with a water-cooled copper roller rotating at a roller surface velocity of 2 m/s to obtain a melt-quenched alloy, pulverizing the alloy with a stamp mill or by hydrogen decrepitation process, and then adjusting the particle sizes to 3 mm or less using a sieve.

Next, an RH diffusion process was carried out using the machine shown in FIG. 3. The cylinder had a volume of 128000 $mm^3$, the weight of the sintered R-T-B based magnet bodies loaded was 50 g, and the weight of the RH diffusion sources loaded was 50 g. As the RH diffusion sources, ones with indefinite shapes with a diameter of 3 mm or less were used.

The RH diffusion process was carried out by introducing argon gas into the processing chamber, which had already been evacuated, and raising the pressure inside the processing chamber to 5 Pa and then heating the chamber with the heater 4 until the RH diffusion temperature (of 820° C.) was reached while rotating the processing chamber. Even if the pressure varied while the temperature was being increased, the pressure was maintained at 5 Pa by either releasing or supplying the Ar gas appropriately. The temperature increase rate was approximately 10° C. per minute. Once the RH diffusion temperature was reached, the temperature was maintained for a predetermined period of time. After that, the heating process was stopped to lower the temperature to room temperature. Subsequently, after the RH diffusion sources were unloaded from the machine shown in FIG. 3, the sintered R-T-B based magnets remaining in the chamber were subjected to a first heat treatment process (at 900° C. for three hours) under Ar at an ambient pressure of 5 Pa and then subjected to a second heat treatment process (at 500° C. for one hour) after the diffusion.

In this example, the sintered R-T-B based magnet body had its each side ground by 0.2 mm after the RH diffusion process to be machined into a cubic shape of 7.0 mm×7.0 mm×7.0 mm, and then had its magnetic properties measured with a B—H tracer. In Table 1, the "RH diffusion source" column indicates the composition of the RH diffusion sources used. The "Fe/RH ratio" column indicates the mass ratio of Fe when the heavy rare-earth element RH included in the RH diffusion sources was supposed to be three by mass ratio. The "surface velocity" column indicates the surface velocity at the inner wall of the cylinder 3 shown in FIG. 3. The "RH diffusion temperature" column indicates the temperature of the RH diffusion process. The "RH diffusion time" column indicates the period of time for which the RH diffusion temperature was maintained. And the "ambient pressure" column indicates the ambient pressure in the cylinder 3 during the RH diffusion process.

As shown in Table 1, Samples #1, #2, #3 and #4 were subjected to the RH diffusion process for mutually different periods of time (specifically, for two, four, six and eight hours, respectively) using the RH diffusion sources of the present invention and at the same surface velocity, same RH diffusion process temperature, and same ambient pressure. The $B_r$ and $H_{cJ}$ values obtained under such a condition are shown in Table 2. Samples #5, #6, #7 and #8 were subjected to the RH diffusion process under the same condition as Samples #1, #2, #3 and #4 except that no light rare-earth elements RL were included in any of the former group of samples and that those samples included Dy in mutually different percentages. FIG. 1 shows a variation in $\Delta H_{cJ}$ of Samples #1 to #4, which is represented by the curve labeled "Invention #1", and a variation in $\Delta H_{cJ}$ of Samples #5 to #8, which is represented by the curve labeled "Comparative Example #1". As can be seen from FIG. 1, the present inventors discovered that when the RH diffusion sources of the present invention were used, $H_{cJ}$ could be increased by carrying out the RH diffusion process for a short time.

It should be noted that $B_r$ did not vary and no adhesion occurred during the RH diffusion process, either, in any of these samples.

TABLE 1

| Sample | RH diffusion source Nd (mass %) | Dy (mass %) | Fe (mass %) | Fe/RH ratio | Surface velocity (m/s) | RH diffusion temperature (° C.) | RH diffusion time (hr) | Ambient pressure (Pa) |
|---|---|---|---|---|---|---|---|---|
| 1 | 6 | 54 | 40 | 2.2 | 0.02 | 820 | 2 | 5 |
| 2 | 6 | 54 | 40 | 2.2 | 0.02 | 820 | 4 | 5 |
| 3 | 6 | 54 | 40 | 2.2 | 0.02 | 820 | 6 | 5 |
| 4 | 6 | 54 | 40 | 2.2 | 0.02 | 820 | 8 | 5 |
| 5 | — | 60 | 40 | 2.0 | 0.02 | 820 | 2 | 5 |
| 6 | — | 60 | 40 | 2.0 | 0.02 | 820 | 4 | 5 |
| 7 | — | 60 | 40 | 2.0 | 0.02 | 820 | 6 | 5 |
| 8 | — | 60 | 40 | 2.0 | 0.02 | 820 | 8 | 5 |

TABLE 2

| Sample | $B_r$ (T) | $H_{cJ}$ (kA/m) |
|---|---|---|
| 1 | 1.41 | 1080 |
| 2 | 1.41 | 1215 |
| 3 | 1.41 | 1255 |
| 4 | 1.41 | 1270 |
| 5 | 1.41 | 1020 |
| 6 | 1.41 | 1080 |
| 7 | 1.41 | 1120 |
| 8 | 1.41 | 1150 |

EXPERIMENTAL EXAMPLE 2

(Adhesion Occurred or not, RH Diffusion Temperature)

Sintered R-T-B based magnets were produced under the condition shown in Table 3 or as in Experimental Example 1 unless no condition or method is specified there.

When the RH diffusion process was carried out at mutually different temperatures (of 600° C., 700° C., 800° C., 850° C., 900° C., 1000° C. and 1020° C., respectively), adhesion sometimes occurred and sometimes didn't as shown in Table 3.

Samples #9 through #17 used the RH diffusion sources of the present invention, while Samples #18 through #30 are comparative examples.

In Table 3, the degree of increase in $H_{cJ}$ as a result of the RH diffusion process is indicated by "$\Delta H_{cJ}$" and the degree of increase in $B_r$ as a result of the RH diffusion process is indicated by "$\Delta B_r$". A negative numerical value indicates that the magnetic property decreased compared to a sintered R-T-B based magnet body that was not subjected to any RH diffusion process. Also, if the "adhesion occurred?" column says "YES", it indicates that the RH diffusion sources adhered to the sintered R-T-B based magnets after having been subjected to the RH diffusion process.

As can be seen from Table 3, in Samples #10 through #14, adhesion did not occur in the range of 700° C. to 1000° C. The $B_r$ and $H_{cJ}$ values of Samples #9 through #30 shown in Table 3 are as shown in Table 4.

Even if the RH diffusion sources of the present invention were used but if the RH diffusion process was carried out at 1020° C., adhesion occurred in Sample #9. That is why the RH diffusion process should be carried out at 1000° C. or less.

Meanwhile, even if the RH diffusion sources of the present invention were used but if the RH diffusion process was carried out at 600° C., $H_{cJ}$ could not be increased so effectively but just slightly as in Sample #15. For these reasons, the decision can be made that the RH diffusion process should be carried out at a temperature that falls within an appropriate range of 700° C. to 1000° C.

On the other hand, if Dy was used as a diffusion source, adhesion occurred at 850° C., 900° C. and 1000° C. as in Samples #18 to #23. And if the diffusion process was carried out using a Dy—Fe alloy as a diffusion source, no adhesion occurred within the range of 700° C. to 1000° C. in Samples #25 to #29, all of which had smaller $\Delta H_{cJ}$ than Samples #10 through #14, though.

In Sample #24, the diffusion process was carried out at 1020° C., and adhesion occurred. However, if the RH diffusion process was carried out at 600° C. as in Sample #30, $H_{cJ}$ could not be increased so effectively.

Figure 2:
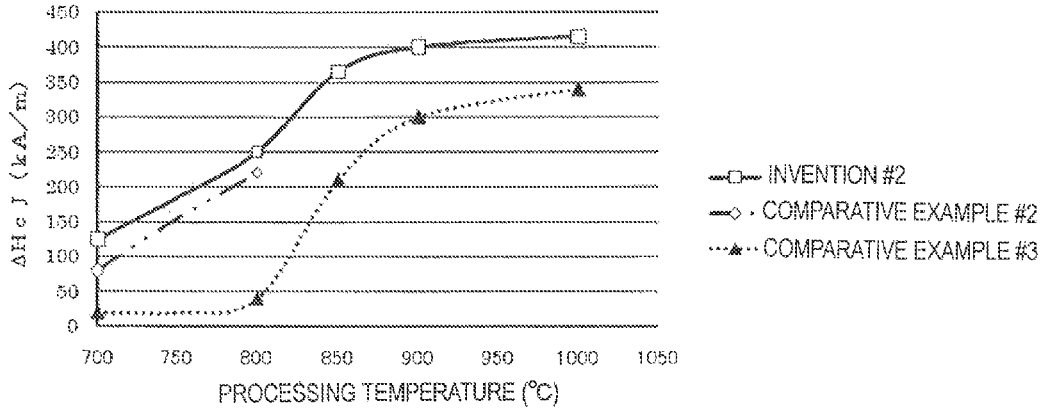
FIG. 2 A graph showing how the $H_{cJ}$ increasing effect changes with the RH diffusion process temperature in the present invention and in a comparative example.

FIG. 2 shows a variation in $\Delta H_{cJ}$ of Samples #10 to #14, which is represented by the curve labeled "Invention #2", a variation in $\Delta H_{cJ}$ of Samples #18 to #22, which is represented by the curve labeled "Comparative Example #2", and a variation in $\Delta H_{cJ}$ of Samples #25 to #29, which is represented by the curve labeled "Comparative Example #3". As can be seen from FIG. 2, $\Delta H_{cJ}$ could be increased very effectively according to "Invention #2" in a wider temperature range of 700° C. to 1000° C. than in "Comparative Example #2" or "Comparative Example #3".

In Sample #16, the RH diffusion process time of Sample #14 was extended to 15 hours. As a result, Sample #16 had magnetic properties including $\Delta H_{cJ}$ that increased somewhat compared to Sample #14.

In Sample #17, the RH diffusion process was carried out at 600° C. for 15 hours. When the magnetic properties of Sample #17 were measured, $\Delta H_{cJ}$ turned out to have slightly increased, but $B_r$ turned out to have decreased, compared to Sample #15. Even if the RH diffusion sources of the present invention were used but if the RH diffusion process was carried out for a long time at 600° C., the heavy rare-earth element RH reached deeper to the vicinity of the center of the main phase around the surface layer of the sintered magnet body to cause a decrease in $B_r$.

It should be noted that Dy metal, consisting of Dy 100%, should not be used, because it is difficult to handle Dy metal, which will get oxidized easily and could fire if handled improperly in the air.

TABLE 3

| Sample | RH diffusion source Nd (mass %) | Dy (mass %) | Fe (mass %) | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) | Adhesion occurred? |
|---|---|---|---|---|---|---|---|---|---|---|---|
| 9 | 5 | 45 | 50 | 3.3 | 0.02 | 1020 | 4 | 5 | — | — | YES |
| 10 | 5 | 45 | 50 | 3.3 | 0.02 | 1000 | 4 | 5 | 410 | 0 | NO |
| 11 | 5 | 45 | 50 | 3.3 | 0.02 | 900 | 4 | 5 | 410 | 0 | NO |
| 12 | 5 | 45 | 50 | 3.3 | 0.02 | 850 | 4 | 5 | 360 | 0 | NO |
| 13 | 5 | 45 | 50 | 3.3 | 0.02 | 800 | 4 | 5 | 240 | 0 | NO |
| 14 | 5 | 45 | 50 | 3.3 | 0.02 | 700 | 4 | 5 | 130 | 0 | NO |
| 15 | 5 | 45 | 50 | 3.3 | 0.02 | 600 | 4 | 5 | 20 | 0 | NO |
| 16 | 5 | 45 | 50 | 3.3 | 0.02 | 700 | 15 | 5 | 220 | 0 | NO |
| 17 | 5 | 45 | 50 | 3.3 | 0.02 | 600 | 15 | 5 | 30 | −0.01 | NO |
| 18 | — | 100 | — | — | 0.02 | 1000 | 4 | 5 | — | — | YES |
| 19 | — | 100 | — | — | 0.02 | 900 | 4 | 5 | — | — | YES |
| 20 | — | 100 | — | — | 0.02 | 850 | 4 | 5 | — | — | YES |
| 21 | — | 100 | — | — | 0.02 | 800 | 4 | 5 | 200 | 0 | NO |
| 22 | — | 100 | — | — | 0.02 | 700 | 4 | 5 | 80 | 0 | NO |
| 23 | — | 100 | — | — | 0.02 | 600 | 4 | 5 | 20 | 0 | NO |
| 24 | — | 50 | 50 | 3 | 0.02 | 1020 | 4 | 5 | — | — | YES |
| 25 | — | 50 | 50 | 3 | 0.02 | 1000 | 4 | 5 | 340 | 0 | NO |
| 26 | — | 50 | 50 | 3 | 0.02 | 900 | 4 | 5 | 300 | 0 | NO |
| 27 | — | 50 | 50 | 3 | 0.02 | 850 | 4 | 5 | 210 | 0 | NO |
| 28 | — | 50 | 50 | 3 | 0.02 | 800 | 4 | 5 | 40 | 0 | NO |
| 29 | — | 50 | 50 | 3 | 0.02 | 700 | 4 | 5 | 20 | 0 | NO |
| 30 | — | 50 | 50 | 3 | 0.02 | 600 | 4 | 5 | 20 | 0 | NO |

TABLE 4

| Sample | $B_r$ (T) | $H_{cJ}$ (kA/m) |
|---|---|---|
| 9 | — | — |
| 10 | 1.41 | 1370 |
| 11 | 1.41 | 1370 |
| 12 | 1.41 | 1320 |
| 13 | 1.41 | 1200 |
| 14 | 1.41 | 1090 |
| 15 | 1.41 | 980 |
| 16 | 1.41 | 1180 |
| 17 | 1.41 | 990 |
| 18 | — | — |
| 19 | — | — |
| 20 | — | — |
| 21 | 1.41 | 1160 |
| 22 | 1.41 | 1040 |
| 23 | 1.41 | 980 |
| 24 | — | — |
| 25 | 1.41 | 1300 |
| 26 | 1.41 | 1260 |

TABLE 4-continued

| Sample | $B_r$ (T) | $H_{cJ}$ (kA/m) |
|---|---|---|
| 27 | 1.41 | 1170 |
| 28 | 1.41 | 1000 |

TABLE 4-continued

| Sample | $B_r$ (T) | $H_{cJ}$ (kA/m) |
|---|---|---|
| 29 | 1.41 | 980 |
| 30 | 1.41 | 980 |

EXPERIMENTAL EXAMPLE 3

(Influence of RH Diffusion Process Time)

Sintered R-T-B based magnets were made under the same condition and by the same method as in Experimental Example 1 except the condition shown in the following Table 5.

To check out the influence of the RH diffusion process time, the RH diffusion process was carried out with the process time changed as in the following Table 5. As a result, after the RH diffusion process was carried out at 900° C. for four hours, no significant variation was seen in $\Delta H_{cJ}$ (see Samples #33 to #36). The $B_r$ and $H_{cJ}$ values of these Samples #31 to #36 of Table 5 are shown in the following Table 6.

TABLE 5

| Sample | RH diffusion source Nd (mass %) | Dy (mass %) | Fe (mass %) | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|
| 31 | 6 | 54 | 40 | 2.2 | 0.04 | 900 | 2 | 10 | 310 | 0 |
| 32 | 6 | 54 | 40 | 2.2 | 0.04 | 900 | 3 | 10 | 380 | 0 |
| 33 | 6 | 54 | 40 | 2.2 | 0.04 | 900 | 4 | 10 | 420 | 0 |
| 34 | 6 | 54 | 40 | 2.2 | 0.04 | 900 | 6 | 10 | 420 | 0 |
| 35 | 6 | 54 | 40 | 2.2 | 0.04 | 900 | 9 | 10 | 420 | 0 |
| 36 | 6 | 54 | 40 | 2.2 | 0.04 | 900 | 12 | 10 | 420 | 0 |

TABLE 6

| Sample | $B_r$ (T) | $H_{cJ}$ (kA/m) |
|---|---|---|
| 31 | 1.41 | 1270 |
| 32 | 1.41 | 1340 |
| 33 | 1.41 | 1380 |
| 34 | 1.41 | 1380 |

TABLE 6-continued

| Sample | $B_r$ (T) | $H_{cJ}$ (kA/m) |
|---|---|---|
| 35 | 1.41 | 1380 |
| 36 | 1.41 | 1380 |

EXPERIMENTAL EXAMPLE 4

(Appropriate Content of Light Rare-Earth Element RL)

Sintered R-T-B based magnets were made under the same condition and by the same method as in Experimental Example 1 except the condition shown in the following Table 7.

The RH diffusion process was carried out using RH diffusion sources with various Fe/RH ratios by changing the Nd content in the order of 0 mass %, 0.2 mass %, 1 mass %, 3 mass %, 6 mass %, 9 mass %, 12 mass %, 18 mass %, 24 mass %, and 30 mass % and then the magnetic properties were measured.

The results are as shown in the following Table 7. The $B_r$ and $H_{cJ}$ values of these Samples #37 to #46 of Table 7 are shown in the following Table 8.

TABLE 7

| Sample | RH diffusion source Nd (mass %) | Dy (mass %) | Fe (mass %) | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|
| 37 | — | 60 | 40 | 2 | 0.02 | 950 | 4 | 5 | 300 | 0 |
| 38 | 0.2 | 59.8 | 40 | 2 | 0.02 | 950 | 4 | 5 | 450 | 0 |
| 39 | 1 | 59 | 40 | 2 | 0.02 | 950 | 4 | 5 | 450 | 0 |
| 40 | 3 | 57 | 40 | 2.1 | 0.02 | 950 | 4 | 5 | 450 | 0 |
| 41 | 6 | 54 | 40 | 2.2 | 0.02 | 950 | 4 | 5 | 450 | 0 |
| 42 | 9 | 51 | 40 | 2.4 | 0.02 | 950 | 4 | 5 | 440 | 0 |
| 43 | 12 | 48 | 40 | 2.5 | 0.02 | 950 | 4 | 5 | 420 | 0 |
| 44 | 18 | 42 | 40 | 2.9 | 0.02 | 950 | 4 | 5 | 410 | 0 |
| 45 | 24 | 36 | 40 | 3.3 | 0.02 | 950 | 4 | 5 | — | — |
| 46 | 30 | 30 | 40 | 4 | 0.02 | 950 | 4 | 5 | — | — |

TABLE 8

| Sample | $B_r$ (T) | $H_{cJ}$ (kA/m) |
|---|---|---|
| 37 | 1.41 | 1260 |
| 38 | 1.41 | 1410 |
| 39 | 1.41 | 1410 |
| 40 | 1.41 | 1410 |
| 41 | 1.41 | 1410 |
| 42 | 1.41 | 1400 |
| 43 | 1.41 | 1380 |
| 44 | 1.41 | 1370 |
| 45 | — | — |
| 46 | — | — |

In Samples #38 through #44 in which the RH diffusion process was carried out at 950° C. for four hours using RH diffusion sources including 0.2 mass % to 18 mass % of Nd, a higher $\Delta H_{cJ}$ could be obtained than in Sample #37 in which the RH diffusion process was carried out for four hours using RH diffusion sources including 0 mass % of Nd. And good magnetic properties were realized in each of these Samples #38 through #44.

Since the RH diffusion source included 0.2 mass % to 18 mass % of Nd, Dy could be introduced efficiently into the sintered R-T-B based magnet bodies, even though the Dy content was small.

In Samples #45 and #46, on the other hand, adhesion occurred and their magnetic properties could not be measured.

EXPERIMENTAL EXAMPLE 5

(Influence of Ambient Pressure During RH Diffusion Process)

Sintered R-T-B based magnets were made under the same condition and by the same method as in Experimental Example 1 except the condition shown in the following Table 9.

To measure the effect of the ambient pressure during the RH diffusion process, the RH diffusion process was carried out at various ambient pressures as shown in the following Table 9. As a result, $H_{cJ}$ increased irrespective of the pressure as long as the ambient pressure fell within the range of 0.1 Pa through 100000 Pa (i.e., in Samples #47 through #56). The $B_r$ and $H_{cJ}$ values of these Samples #47 to #56 of Table 9 are shown in the following Table 10.

TABLE 9

| Sample | RH diffusion source Nd (mass %) | Dy (mass %) | Fe (mass %) | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|
| 47 | 3 | 57 | 40 | 2.1 | 0.02 | 950 | 4 | 1 | 450 | 0 |
| 48 | 3 | 57 | 40 | 2.1 | 0.02 | 950 | 4 | 2 | 450 | 0 |
| 49 | 3 | 57 | 40 | 2.1 | 0.02 | 950 | 4 | 5 | 450 | 0 |
| 50 | 3 | 57 | 40 | 2.1 | 0.02 | 950 | 4 | 10 | 440 | 0 |
| 51 | 3 | 57 | 40 | 2.1 | 0.02 | 950 | 4 | 100 | 420 | 0 |
| 52 | 3 | 57 | 40 | 2.1 | 0.02 | 950 | 4 | 100000 | 410 | 0 |

TABLE 9-continued

| Sample | RH diffusion source Nd (mass %) | Dy | Fe | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|
| 53 | 4 | 36 | 60 | 5 | 0.03 | 920 | 5 | 0.1 | 400 | 0 |
| 54 | 4 | 36 | 60 | 5 | 0.03 | 920 | 5 | 0.5 | 400 | 0 |
| 55 | 4 | 36 | 60 | 5 | 0.03 | 920 | 5 | 10 | 390 | 0 |
| 56 | 4 | 36 | 60 | 5 | 0.03 | 920 | 5 | 100 | 370 | 0 |

TABLE 10

| Sample | $B_r$ (T) | $H_{cJ}$ (kA/m) |
|---|---|---|
| 47 | 1.41 | 1410 |
| 48 | 1.41 | 1410 |
| 49 | 1.41 | 1410 |
| 50 | 1.41 | 1400 |
| 51 | 1.41 | 1380 |
| 52 | 1.41 | 1370 |
| 53 | 1.41 | 1360 |
| 54 | 1.41 | 1360 |
| 55 | 1.41 | 1350 |
| 56 | 1.41 | 1330 |

EXPERIMENTAL EXAMPLE 6

(Ratio of Fe to RH)

Sintered R-T-B based magnets were made under the same condition and by the same method as in Experimental Example 1 except the condition shown in the following Table 11. The $B_r$ and $H_{cJ}$ values of these Samples #57 to #64 of Table 11 are shown in the following Table 12.

These results reveal that when carried out at 920° C. using the RH diffusion sources of the present invention (Samples #58 through #62), of which the Nd content was 0.2 mass % to 18 mass % and which had a ratio of Fe to Dy (which is a heavy rare-earth element RH) of three to two to three to seven, the RH diffusion process could get done without causing any adhesion.

On the other hand, in Sample #57 which had an Fe to Dy ratio of less than two, adhesion occurred. And in Samples #63 and #64 which had an Fe to Dy ratio of more than seven, $H_{cJ}$ could not be increased so effectively even though Nd was added.

TABLE 11

| Sample | RH diffusion source Nd (mass %) | Dy | Fe | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) | Adhesion occurred? |
|---|---|---|---|---|---|---|---|---|---|---|---|
| 57 | 18 | 52 | 30 | 1.7 | 0.01 | 920 | 5 | 2 | — | — | YES |
| 58 | 6 | 54 | 40 | 2.2 | 0.01 | 920 | 5 | 2 | 400 | 0 | NO |
| 59 | 5 | 45 | 50 | 3.3 | 0.01 | 920 | 5 | 2 | 400 | 0 | NO |
| 60 | 4 | 36 | 60 | 5 | 0.01 | 920 | 5 | 2 | 400 | 0 | NO |
| 61 | 3 | 33 | 64 | 5.8 | 0.01 | 920 | 5 | 2 | 320 | 0 | NO |
| 62 | 3 | 30 | 67 | 6.7 | 0.01 | 920 | 5 | 2 | 290 | 0 | NO |
| 63 | 3 | 27 | 70 | 7.8 | 0.01 | 920 | 5 | 2 | 190 | 0 | NO |
| 64 | 2 | 18 | 80 | 13.3 | 0.01 | 920 | 5 | 2 | 140 | 0 | NO |

As can be seen from the results of this Experimental Example 6, when the RH diffusion sources of the present invention were used, the RH diffusion process could get done efficiently without causing adhesions by setting the Fe/RH ratio to fall within the range of three to two to three to seven.

TABLE 12

| Sample | $B_r$ (T) | $H_{cJ}$ (kA/m) |
|---|---|---|
| 57 | — | — |
| 58 | 1.41 | 1360 |
| 59 | 1.41 | 1360 |
| 60 | 1.41 | 1360 |
| 61 | 1.41 | 1280 |
| 62 | 1.41 | 1250 |
| 63 | 1.41 | 1150 |
| 64 | 1.41 | 1100 |

EXPERIMENTAL EXAMPLE 7

(Nd and Dy are Replaced with Pr and Tb, Respectively)

Sintered R-T-B based magnets were made under the same condition and by the same method as in Experimental Example 1 except the condition shown in the following Table 13. The $B_r$ and $H_{cJ}$ values of these Samples #65 to #68 of Table 13 are shown in the following Table 14.

When Nd in the RH diffusion source of Sample #40 was entirely replaced with Pr (to obtain Sample #65), it turned out that the coercivity could be increased through the RH diffusion process as effectively as in Sample #40.

On the other hand, when Nd in the RH diffusion source of Sample #41 was partially replaced with Pr (to obtain Sample #66), it turned out that the coercivity could be increased through the RH diffusion process as effectively as in Sample #41.

Furthermore, when Dy in the RH diffusion source of Sample #40 was partially replaced with Tb (to obtain Sample #67), it turned out that a higher $H_{cJ}$ was achieved as a result of the replacement with Tb than in Sample #40.

And when Dy in the RH diffusion source of Sample #40 was entirely replaced with Tb (to obtain Sample #68), it turned out that an even higher $H_{cJ}$ was achieved as a result of the replacement with Tb than in Sample #40.

TABLE 13

| Sample | RH diffusion source Nd (mass %) | Pr | Dy | Tb | Fe | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|---|---|
| 65 | — | 3 | 57 | — | 40 | 2.1 | 0.02 | 950 | 4 | 5 | 450 | 0 |
| 66 | 3 | 3 | 54 | — | 40 | 2.1 | 0.02 | 950 | 4 | 5 | 450 | 0 |
| 67 | 3 | — | 27 | 30 | 40 | 2.1 | 0.02 | 950 | 4 | 5 | 620 | 0 |
| 68 | 3 | — | — | 57 | 40 | 2.1 | 0.02 | 950 | 4 | 5 | 760 | 0 |

TABLE 14

| Sample | $B_r$ (T) | $H_{cJ}$ (kA/m) |
|---|---|---|
| 65 | 1.41 | 1410 |
| 66 | 1.41 | 1410 |
| 67 | 1.41 | 1580 |
| 68 | 1.41 | 1720 |

EXPERIMENTAL EXAMPLE 8

(Influence of Surface Velocity of RH Diffusion Process Vessel)

Sintered R-T-B based magnets were made under the same condition and by the same method as in Experimental Example 1 except the condition shown in the following Table 15.

To measure the effect of the surface velocity of the RH diffusion process vessel during the RH diffusion process, the RH diffusion process was carried out with the surface velocity changed as shown in the following Table 15. As a result, when the RH diffusion process was carried out at 920° C., the effect of increasing $H_{cJ}$ hardly changed even if the surface velocity was changed within the range of 0.01 m/s through 0.50 m/s (i.e., in Samples #69 through #74). The $B_r$ and $H_{cJ}$ values of these Samples #69 to #74 of Table 15 are shown in the following Table 16.

TABLE 15

| Sample | RH diffusion source Nd (mass %) | Dy | Fe | Fe/RH ratio | Surface velocity (m/s) | RH diffusion temperature (° C.) | RH diffusion time (hr) | Ambient pressure (Pa) | $\Delta H_{cJ}$ (kA/m) | $\Delta B_r$ (T) |
|---|---|---|---|---|---|---|---|---|---|---|
| 69 | 5 | 55 | 40 | 2.2 | 0.01 | 920 | 5 | 1 | 440 | 0 |
| 70 | 5 | 55 | 40 | 2.2 | 0.05 | 920 | 5 | 1 | 440 | 0 |
| 71 | 5 | 55 | 40 | 2.2 | 0.10 | 920 | 5 | 1 | 440 | 0 |
| 72 | 5 | 55 | 40 | 2.2 | 0.20 | 920 | 5 | 1 | 440 | 0 |
| 73 | 5 | 55 | 40 | 2.2 | 0.40 | 920 | 5 | 1 | 440 | 0 |
| 74 | 5 | 55 | 40 | 2.2 | 0.50 | 920 | 5 | 1 | 440 | 0 |

TABLE 16

| Sample | $B_r$ (T) | $H_{cJ}$ (kA/m) |
|---|---|---|
| 69 | 1.41 | 1400 |
| 70 | 1.41 | 1400 |
| 71 | 1.41 | 1400 |
| 72 | 1.41 | 1400 |
| 73 | 1.41 | 1400 |
| 74 | 1.41 | 1400 |

The heat pattern that can be adopted in the diffusion process of the present invention does not have to be the one used in these experimental examples but may also be any of various other patterns. Also, the vacuum evacuation may be performed until the diffusion process gets done and the sintered magnet body gets cooled sufficiently.

INDUSTRIAL APPLICABILITY

According to the present invention, a sintered R-T-B based magnet can be produced so that its $B_r$ and $H_{cJ}$ are both high. The sintered magnet of the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder made of stainless steel (processing chamber)
4 heater
5 cap
6 exhaust system

The invention claimed is:

1. A method for producing a sintered R-T-B based magnet, the method comprising the steps of:

providing a sintered R-T-B based magnet body, where R is a rare-earth element, and T is a transition metal element which is mostly comprised of Fe, and B is boron;

providing an RH diffusion source which is an alloy comprising: 0.2 mass % to 18 mass % of light rare-earth element RL, which is at least one of Nd and Pr; 40 mass % to 70 mass % of Fe; and a heavy rare-earth element RH, which is at least one of Dy and Tb, as the balance, wherein Fe/RH ratio is within a range from two to seven, the Fe/RH ratio being defined by a mass fraction of Fe when a mass fraction of the heavy rare-earth element RH included in the RH diffusion sources is three; and performing an RH diffusion process by loading the sintered R-T-B based magnet body, a stirring aid member, and the RH diffusion source into a processing chamber so that the sintered R-T-B based magnet body, the stirring aid member, and the RH diffusion source are movable relative to each other, and by heating the sintered R-T-B based magnet body, the stirring aid member, and the RH diffusion source to a processing temperature of 700° C. to 1000° C. while moving the sintered R-T-B based magnet body and the RH diffusion source in the processing chamber either continuously or discontinuously by rotating or rocking the processing chamber.

2. The method of claim 1, wherein the stirring aid member is made of zirconia, silicon nitride, silicon carbide, boron nitride, or any combination thereof.

* * * * *